US009956684B2

(12) United States Patent
Welfel et al.

(10) Patent No.: US 9,956,684 B2
(45) Date of Patent: May 1, 2018

(54) BUCKET INSERT FOR STORING AND TRANSPORTING ELONGATE OBJECTS

(71) Applicant: Bryan C. Welfel, River Vale, NJ (US)

(72) Inventors: Bryan C. Welfel, River Vale, NJ (US); Jared T. Jordan, River Vale, NJ (US)

( * ) Notice: Subject to any disclaimer, the term of this patent is extended or adjusted under 35 U.S.C. 154(b) by 353 days.

(21) Appl. No.: 14/745,991

(22) Filed: Jun. 22, 2015

(65) Prior Publication Data

US 2016/0368133 A1 Dec. 22, 2016

(51) Int. Cl.

*B65D 85/20* (2006.01)
*B25H 3/06* (2006.01)
*B25H 3/00* (2006.01)

(52) U.S. Cl.

CPC ..... *B25H 3/06* (2013.01); *B25H 3/003* (2013.01)

(58) Field of Classification Search

CPC ..... B25H 3/003; B25H 3/06
USPC ..... 206/349, 372, 373, 443, 446, 499; 211/70.6; 220/735
See application file for complete search history.

(56) References Cited

U.S. PATENT DOCUMENTS 5,137,319 A * 8/1992 Sauder ..... A01K 97/10 206/315.11
5,271,520 A * 12/1993 McAfee ..... A01K 97/06 206/315.11
5,379,885 A * 1/1995 Chen ..... B25H 3/04 206/216
5,678,348 A * 10/1997 Zielinski ..... A01K 97/08 211/70.8
5,772,050 A * 6/1998 Shih ..... B41K 1/58 211/163
5,836,446 A * 11/1998 Varnom ..... B25H 3/06 206/373
5,971,333 A 10/1999 Fiedor
6,209,721 B1 * 4/2001 Sharpe ..... A63B 55/00 206/315.2
6,254,055 B1 7/2001 Lamberson, Jr.
6,360,891 B1 3/2002 Rideout
7,159,735 B2 1/2007 Morse
7,676,983 B2 * 3/2010 Jenkins ..... A01K 97/06 248/512
7,954,650 B1 6/2011 Malik
8,127,965 B1 3/2012 Miller
D685,971 S * 7/2013 Thibault ..... D32/54
2007/0084810 A1 * 4/2007 Morris ..... A47K 1/09 211/65

* cited by examiner

*Primary Examiner* — Luan K Bui
(74) *Attorney, Agent, or Firm* — Law Offices of Michael L. Wise, LLC

(57) ABSTRACT

An apparatus for conveniently organizing, storing, and transporting elongate objects such as pipe nipples is described. The apparatus includes a bucket, within which an upper tray is suspended above a lower tray by a pillar. Holes in the upper tray align with holes in the lower tray. When an elongate object is passed through these holes, flexible tabs on each of the holes act to firmly grip the object so that it remains safely vertical in the bucket. At the same time, projections on the perimeters of the upper and lower trays act to stop the trays from moving inside the bucket.

14 Claims, 6 Drawing Sheets

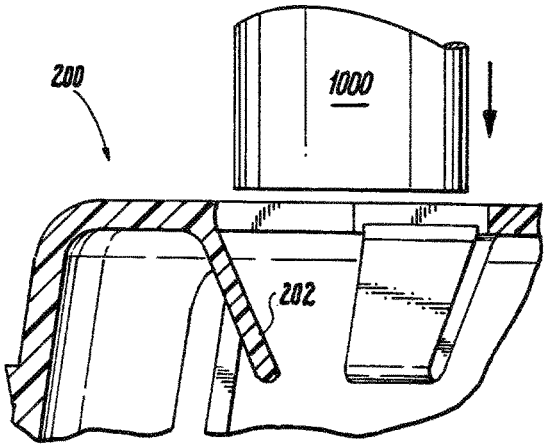
Fig. 8
Fig. 9
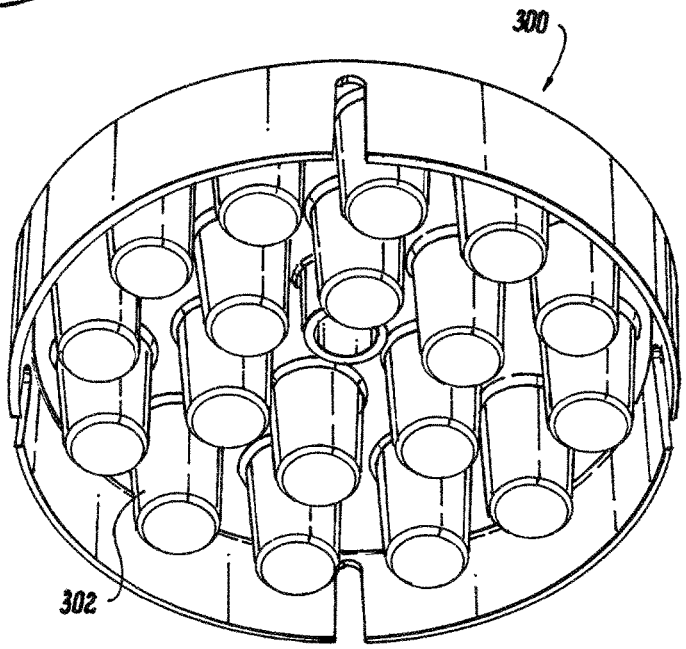
Fig. 10
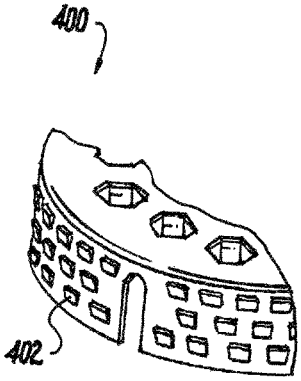
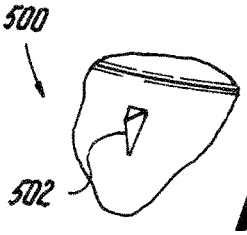
Fig. 11

BUCKET INSERT FOR STORING AND TRANSPORTING ELONGATE OBJECTS

FIELD OF THE INVENTION

The present invention relates generally to storage means, and, more particularly, to bucket inserts to assist in organizing, storing, and transporting elongate objects.

BACKGROUND OF THE INVENTION

A pipe nipple is typically a short piece of pipe with male pipe threads at each end. Pipe nipples are used extensively to interconnect two other fittings in plumbing applications. They come in various diameters and lengths, as well as in numerous materials and with several screw thread types.

Because of the myriad of possible applications for pipe nipples, a plumber must frequently carry a number of different pipe nipples to a job site. If, during transport, the threads on a pipe nipple are damaged, that pipe nipple becomes unusable. As a result, there is a need for a convenient means for organizing, storing, and transporting pipe nipples and other elongate objects while protecting these objects from damage.

SUMMARY OF THE INVENTION

Embodiments of the present invention address the above-identified needs by providing apparatus for conveniently organizing, storing, and transporting elongate objects such as pipe nipples, while protecting those objects from damage.

Aspects of the invention are directed to a kit including an upper tray, a lower tray, and a pillar. The upper tray comprises an upper disk, a plurality of upper edge projections, and an upper socket. The upper disk defines a plurality of upper holes therethrough. The plurality of upper edge projections project from a circumference of the upper disk. The lower tray comprises a lower socket. The pillar is insertable into the upper socket and into the lower socket so as to span therebetween.

Additional aspects of the invention are directed to an apparatus comprising a bucket, an upper tray, a lower tray, and a pillar. The bucket comprises a base and a cylindrical sidewall attached to the base. The upper tray occupies the bucket and comprises an upper disk, a plurality of upper edge projections, and an upper socket. The upper disk defines a plurality of upper holes therethrough. The plurality of upper edge projections project from a circumference of the upper disk. The lower tray occupies the bucket and comprises a lower socket. The pillar occupies the bucket and is inserted into the upper socket and into the lower socket so as to suspend the upper tray over the lower tray when the base is resting on a level surface.

Advantageously, embodiments in accordance with aspects of the invention may utilize five-gallon buckets that are readily available at many hardware stores. Moreover, these embodiments may be designed to be "universal," meaning that they are able to accommodate elongate objects of various widths/diameters, lengths, and materials without modification or customization. Lastly, elements in accordance with aspects of the invention may be reduced to a very compact form when not being used for storage and transport, as well as for display on store shelves.

BRIEF DESCRIPTION OF THE DRAWINGS

These and other features, aspects, and advantages of the present invention will become better understood with regard to the following description, appended claims, and accompanying drawings where:

FIG. 8 shows a magnified sectional view of a portion of an upper tray with modified upper hole tabs, in accordance with an alternative illustrative embodiment of the invention;

FIG. 9 shows a bottom perspective view of a lower tray with receiving cups, in accordance with an alternative illustrative embodiment of the invention;

FIG. 10 shows a magnified perspective view of a portion of an upper tray with modified upper teeth, in accordance with an alternative embodiment of the invention;

FIG. 11 shows another magnified perspective view of a portion of an upper tray with modified upper teeth, in accordance with even another alternative embodiment of the invention;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used in the present description and the appended claims, the term "angled" means projecting at a non-zero angle. In addition, an element is "substantially identical" to another element if the two elements are manufactured within reasonable manufacturing tolerances of one another.

Figure 1:
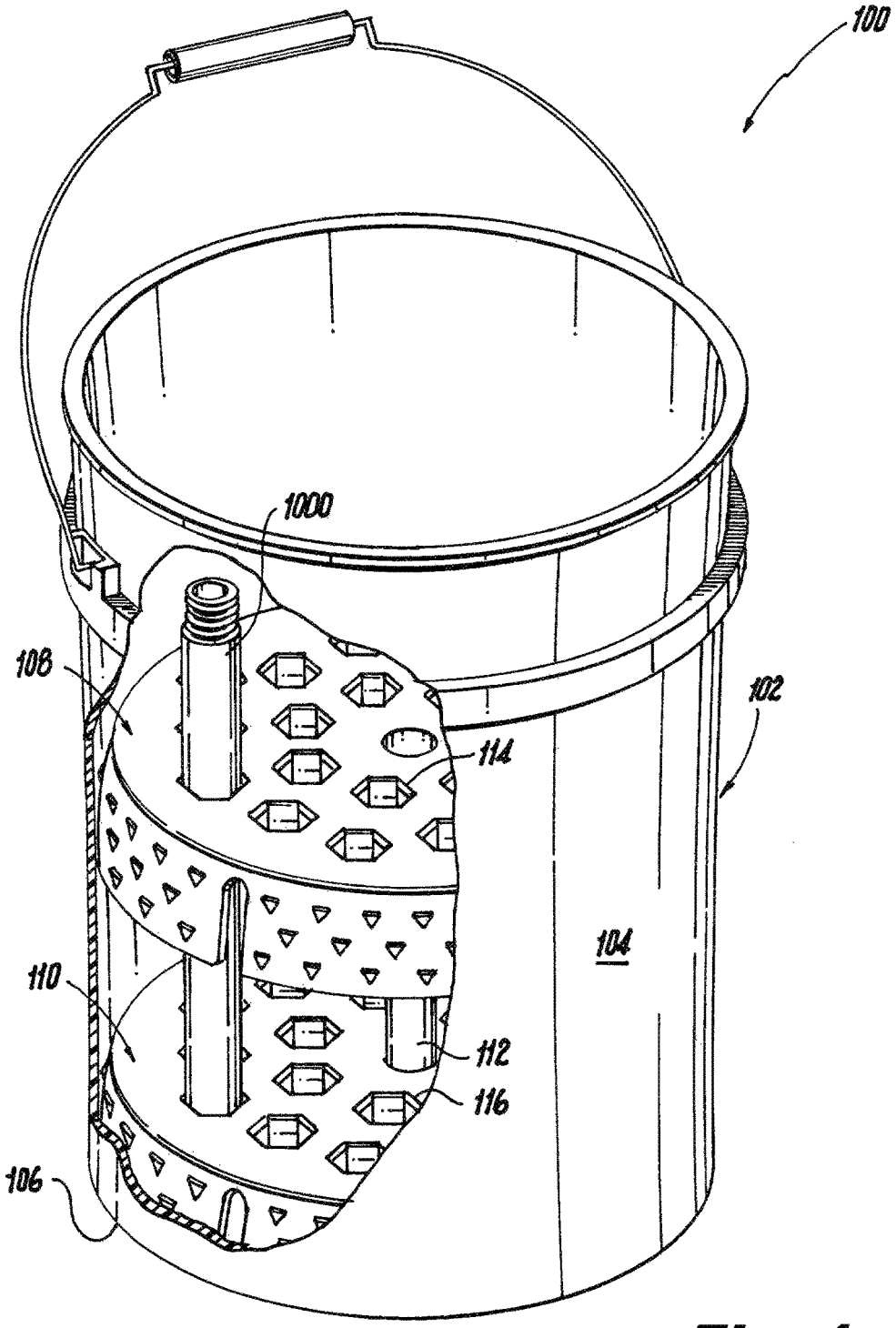
FIG. 1 shows a partially-broken perspective view of an apparatus in accordance with an illustrative embodiment of the invention while being used to store a pipe nipple.

FIG. 1 shows a partially-broken perspective view of an apparatus 100 in accordance with an illustrative embodiment of the invention while the apparatus 100 is being used to store a pipe nipple 1000. The apparatus comprises a bucket 102 with a cylindrical sidewall 104 that is attached to a base 106. The bucket 102 is occupied by an upper tray 108, a lower tray 110, and a pillar 112. The pillar 112 is inserted into the upper tray 108 and into the lower tray 110 so as to span therebetween. In so doing, the pillar 112 suspends the upper tray 108 over the lower tray 110 with the base 106 of the bucket 102 resting on a level surface. The pipe nipple 1000 passes through one of a plurality of upper holes 114 in the upper tray 108 and a matching one of a plurality of lower holes 116 in the lower tray 110 so that the pipe nipple 1000 is supported vertically in the bucket 102.

In the present illustrative embodiment, the bucket 102 is a five-gallon bucket like the kind commonly available at many hardware stores. Although there is some variation in dimensions from one manufacturer to another, dimensions of these types of buckets tend to be similar. A representative version of such a bucket is manufactured by Pro-Western Plastics Ltd (St. Albert, Alberta, Canada). Their "5 U.S. Gallon Pail," Part No. 740, has a height of about 37 centimeters (cm). The cylindrical sidewall of the bucket is somewhat tapered with an outside diameter of about 31 cm near its top and about 26 cm near its base. Wall thickness is about 0.20 cm. The bucket is formed of high density polyethylene and includes a metal handle. As would be expected, volume is nominally five U.S. gallons or 19 liters.

Figure 2:
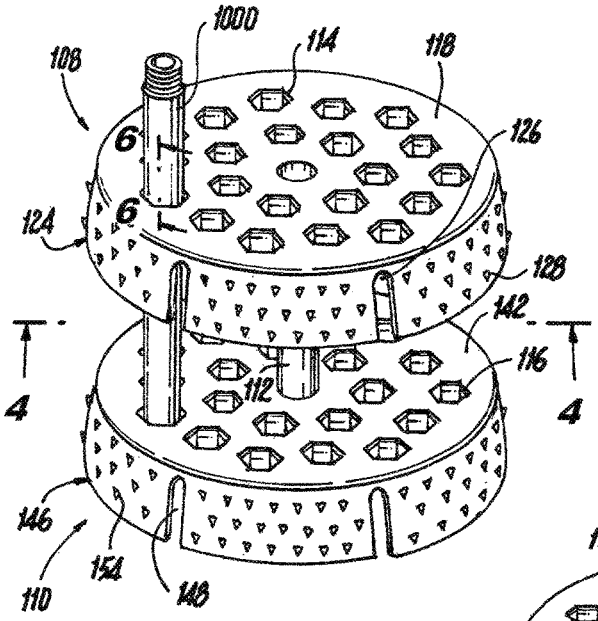
FIG. 2 shows a perspective view of the upper tray, the lower tray, the pillar, and the pipe nipple in FIG. 1.
Figure 3:
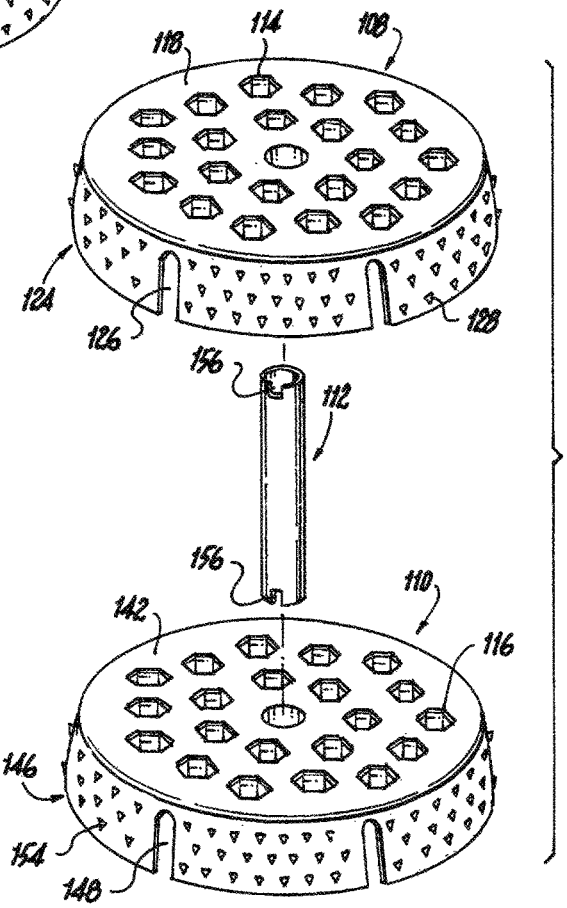
FIG. 3 shows an exploded perspective view of the upper tray, the lower tray, and the pillar in FIG. 1.
Figure 4:
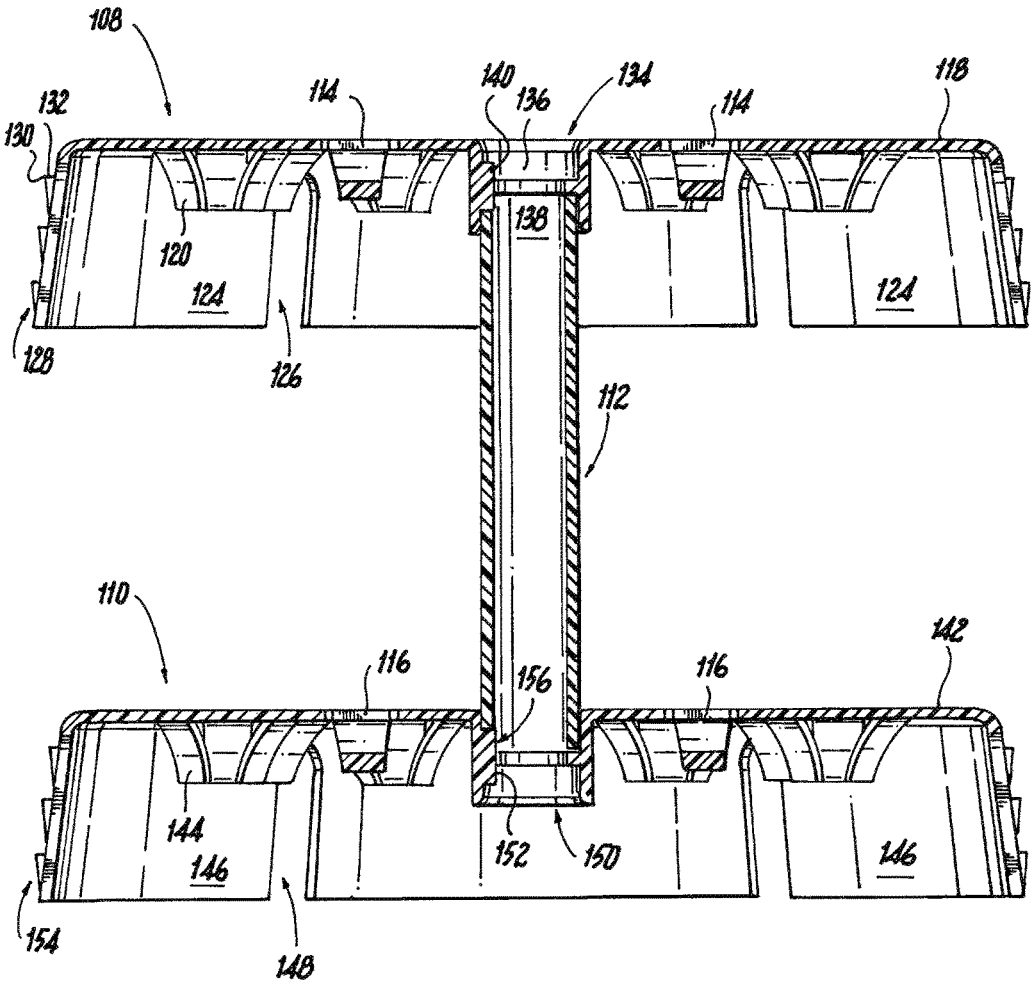
FIG. 4 shows a sectional view of the upper tray, the lower tray, and the pillar in FIG. 1 along the plane indicated in FIG. 2.

Additional details of the upper tray 108, the lower tray 110, and the pillar 112 are presented in FIGS. 2-4 with FIG. 2 showing a perspective view of these elements, FIG. 3 showing an exploded perspective view, and FIG. 4 showing a sectional view along the plane indicated in FIG. 2. The upper tray 108 comprises an upper disk 118, which defines the plurality of upper holes 114 that pass therethrough. In the present, non-limiting embodiment, the upper holes 114 are hexagonal. A respective set of three upper hole tabs 120 project from a perimeter of each of the upper holes 114 towards the base 106 of the bucket 102. The upper hole tabs 120 describe an arc along their respective lengths. That is, the upper hole tabs 120 are arcuate in profile.

The upper tray 108 further comprises a plurality of upper edge projections 124, which project at an angle from a circumference of the upper disk 118, again, towards the base 106 of the bucket 102. These upper edge projections 124 are separated by upper gaps 126. In the present non-limiting embodiment, there are six upper edge projections 124 separated by six upper gaps 126. The upper edge projections 124 project downward towards the base of the bucket 102 and thereby form a "skirt" about the upper tray 108. A plurality of upper teeth 128 project from the upper edge projections and are substantially triangular in profile so that each upper tooth 128 defines a respective sharp edge 130 and a respective ledge 132 (FIG. 4). The upper edge projections 124 are substantially longer than the upper hole tabs 120. That is, the upper edge projections 124 project substantially further from the upper disk 118 than do the upper hole tabs 120.

The upper tray 108 even further comprises a central upper socket 134 adapted to receive the pillar 112. The upper socket 134 defines a first socket portion 136 adapted to receive the pillar 112 from the top, and a second socket portion 138 adapted to receive the pillar 112 from the bottom. The first and second socket portions 136, 138 are essentially mirror images of one another across a horizontal plane that bisects the upper socket 134. The two portions define an upper guide tab 140.

The lower tray 110 is substantially identical to the upper tray 108 and comprises a lower disk 142, lower holes 116, lower hole tabs 144, lower edge projections 146, lower gaps 148, and a lower socket 150 (with a lower guide tab 152). The lower edge projections 146 also define lower teeth 154.

In the present illustrative embodiment, the pillar 112 is substantially hollow cylindrical and includes mutually aligned, longitudinal slots 156 at each end. These slots 156 are positioned and dimensioned to engage the upper and lower guide tabs 140, 152 in the sockets 134, 150 of the trays 108, 110. With the pillar 112 spanning between the upper and lower trays 108, 110 so that the slots 156 engage the guide tabs 140, 152, the upper holes 114 in the upper tray 108 are aligned with the lower holes 116 in the lower tray 110. The slots 156 and the guide tabs 140, 152 maintain this alignment by inhibiting rotation of the upper tray 108 relative to the lower tray 110, and vice versa.

The upper tray 108, the lower tray 110, and the pillar 112 are preferably formed of a plastic with sufficient elasticity to allow the hole tabs 120, 144 and the edge projections 124, 146 to flex somewhat relative to the upper and lower disks 118, 142 under load, and to subsequently resume their normal shapes and orientations after the load is removed. Suitable plastics include, as just two examples, polypropylene and polyethylene. Once the material is chosen, the upper tray 108, the lower tray 110, and the pillar 112 may be formed from conventional plastic manufacturing techniques, which will already be familiar to one having ordinary skill in the relevant manufacturing arts. Reference is also made to P. Mitchell (editor), *Tool and Manufacturing Engineers Handbook: Plastic Part Manufacturing*, Society of Manufacturing Engineers, 1996, which is hereby incorporated by reference herein. One suitable manufacturing technique is, for example, plastic injection molding.

The upper disk 118 and the lower disk 142 preferably have diameters that are somewhat smaller than the inside diameters of the bucket 102 at the locations where they are to be positioned in the bucket 102. At the same time, the upper tray 108 and the lower tray 110 (including their edge projections 124, 146) preferably have diameters that are somewhat larger than the inside diameter of the bucket 102, again, at the locations where they are to be positioned in the bucket 102. In the present embodiment, the upper tray 108 is positioned about half way up the bucket 102, while the lower tray 110 rests on the base 106 of the bucket 102. If it is assumed, purely for illustration, that the bucket 102 is tapered and has an inside diameter of about 28 cm midway in height (i.e., where the upper tray 108 is to be positioned) and about 26 cm near its bottom (i.e., where the lower tray 110 is to be positioned), then the upper and lower disks 118, 142 may preferably have diameters of about 25 cm, and the upper and lower trays 108, 110 (including their edge projections 124, 146) may preferably have diameters of 29 cm. It is reinforced, however, that these dimensions are merely illustrative and should not be construed as limiting the scope of the invention.

Dimensioned in this manner, the edge projections 124, 146 of the upper and lower trays 108, 110 must flex inward somewhat as the trays 108, 110 are forced into their respective positions in the bucket 102 in order to accommodate the smaller inner diameters of the cylindrical sidewall 104. The edge projections 124, 146 resist this flexing and, in so doing, apply outward-directed forces against the inside of the cylindrical sidewall 104, or, stated in the inverse, the cylindrical sidewall 104 applies compressive forces to the edge projections 124, 146. These forces create static friction between the edge projections 124, 146 and the cylindrical sidewall 104. At the same time, the sharp profiles of the upper and lower teeth 128, 154 cause them to "bite into" the cylindrical sidewall 104, further enhancing the static friction between the trays 108, 110 and the bucket 102. The resultant friction inhibits the trays 108, 110 from rising in the bucket 102 and from rotating in the bucket 102. Once placed, the trays 108, 110 tend to stay in place. Mutual alignment between the upper tray 108 and the lower tray 110 is further assured by the guide tabs 140, 152 in the socket 134, 150 and the slots 156 in the pillar 112.

Figure 5:
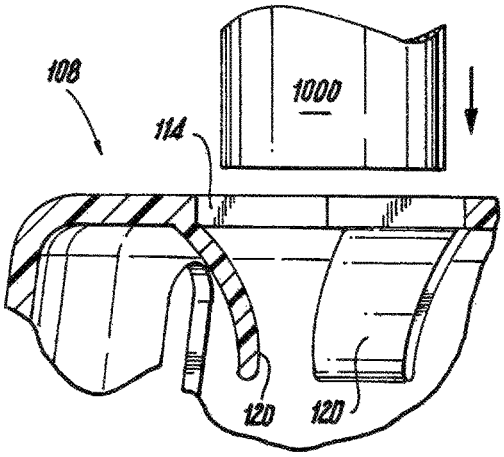
FIG. 5 shows a magnified sectional view of a portion of the FIG. 1 upper tray before insertion of the pipe nipple.
Figure 6:
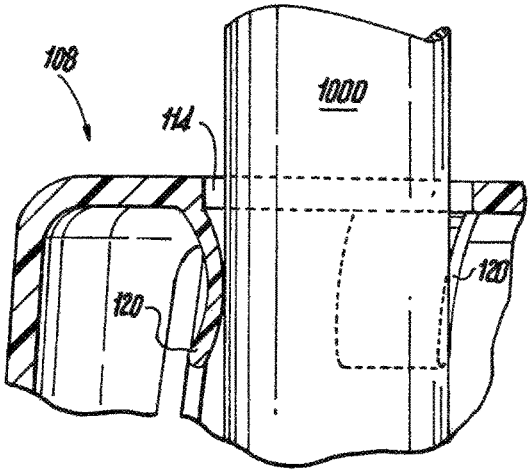
FIG. 6 shows a magnified sectional view of a portion of the FIG. 1 upper tray along the plane indicated in FIG. 2 after insertion of the pipe nipple.

While the pipe nipple 1000 is shown in the figures, it is contemplated that the apparatus 100 may be utilized to organize, store, and transport any variety of elongate objects or objects that contain elongate portions, such as rakes, shovels, and other tools with elongate cylindrical handles. The ability to hold pipe nipples and other elongate objects with various widths and diameters is aided by the upper and lower hole tabs 120, 144. FIGS. 5 and 6 show magnified sectional views of a portion of the upper tray 108 before and after insertion of the pipe nipple 1000, respectively. When an elongate object is inserted into one of the holes 114, 116, the set of hole tabs 120, 144 associated with that hole 114, 116 are forced outward. The wider or greater the diameter of the inserted elongate object, the more outward the hole tabs 120, 144 must flex. Like the edge projections 124, 146, the hole tabs 120, 144 resist this flexing and, in this case, apply compressive gripping forces to the elongate object. The resultant gripping action inhibits movement of the elongate object and holds it securely in a vertical orientation relative to the base of the bucket 102. Because of the curved profile of the hole tabs 120, 144, the gripping force is distributed over a substantial region of the elongate object rather than being focused only onto a smaller area. Holding power is thereby enhanced. Wear on the hole tabs 120, 144 themselves is also reduced.

To aid in organizing the elongate objects stored in the apparatus 100, labels may optionally be added to the trays 108, 110 to indicate what is intended to go into what holes 114, 116. The labels may utilize wording, numbers, symbols, color coding, and so forth. Some holes 114, 116 may, for example, be labeled to hold pipe nipples of different diameters. Additionally or alternatively, some holes may be labeled to hold pipe nipples with different lengths or different pipe threads, and so forth. The apparatus 100 thereby becomes a means for organizing pipe nipples or other elongate objects, in addition to an effective means for safely storing and transporting these items.

Based on the discussion above, it will be recognized that the apparatus 100 provides an effective tool for storing, transporting, and organizing elongate objects such as, but not limited to, pipe nipples. The apparatus 100 may utilize five-gallon buckets that are readily available at many hardware stores. Moreover, the apparatus 100 is "universal," meaning it is able to accommodate elongate objects of various widths/diameters, lengths, and materials without modification or customization.

Figure 7:
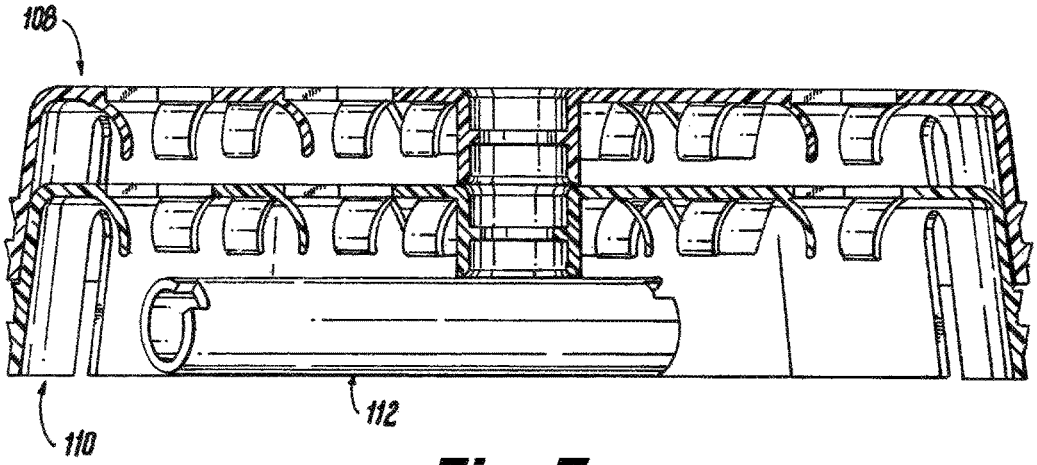
FIG. 7 shows a sectional view of the upper tray, the lower tray, and the pillar from FIG. 1 with these elements nested to achieve a compact form.

Moreover, the trays 108, 110 and the pillar 112 may be stored in a compact form when not in use. The upper and lower trays 108, 110 may be made to nest with each other, and the pillar 112 may be contained inside the volume of the lower tray 110. FIG. 7 shows a sectional view of the upper tray 108, the lower tray 110, and the pillar 112 with these elements arranged in their compact form. This compact form may be of particular advantage when the trays 108, 110 and the pillar 112 are displayed for sale, and store shelf space is at a premium.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

In alternative embodiments, for example, there may be a fewer or a greater number of holes from what is described above, and/or the holes may have different shapes. The holes, for instance, may be round or may be polygonal with greater or fewer than six sides. At the same time, a fewer or a greater number of hole tabs may be associated with each hole. A fewer or greater number of edge projections may also be utilized.

The hole tabs may also have a different shape. FIG. 8 shows a magnified sectional view of a portion of an upper tray 200 with modified upper hole tabs 202, in accordance with an alternative illustrative embodiment of the invention. In this particular embodiment, the upper hole tabs 202 are straight rather than being arcuate. Independent of their exact shape, additional reinforcing material (e.g., plastic ribs) may also be added to the hole tabs to increase the strength of these elements and to tune their levels of elasticity.

The lower tray, moreover, may be different from the upper tray and may forego hole tabs altogether. FIG. 9 shows a bottom perspective view of a lower tray 300 in accordance with another alternative illustrative embodiment of the invention. In the alternative lower tray 300, lower holes are round, and a respective receiving cup 302 is suspended from the respective perimeter of each of the lower holes. Each receiving cup 302 is tapered such that it gets narrower in diameter as one moves downward, but such a profile is only one of many possible profiles that will fall within the scope of the invention. In use, the receiving cups 302 receive the elongate object, and if the elongate object is sufficiently wide or has a large enough diameter, act to place compressive gripping force on that received elongate object.

Alternative designs may be utilized to increase static friction between the upper and lower trays and the cylindrical sidewall of the bucket so as to keep the trays in place. For example, alternative forms of teeth may be designed into the upper and lower edge projections, as shown in FIGS. 10 and 11. FIG. 10 shows a magnified perspective view of a portion of an upper tray 400 with modified upper teeth 402 in accordance with a first alternative design, while FIG. 11 shows a similar view of a portion of an upper tray 500 with modified upper teeth 502 in accordance with a second alternative design. If the trays are to be permanently placed into the bucket, an adhesive may be placed between the edge projections and the cylindrical sidewall. In other embodiments, a band of material characterized by a high coefficient of friction with the bucket material (e.g., a band of rubber) may be placed between the edge projections and the cylindrical sidewall. In even other embodiments, screws may be made to penetrate through the bucket into the edge projections to further assure that the trays remain in place.

Figure 12:
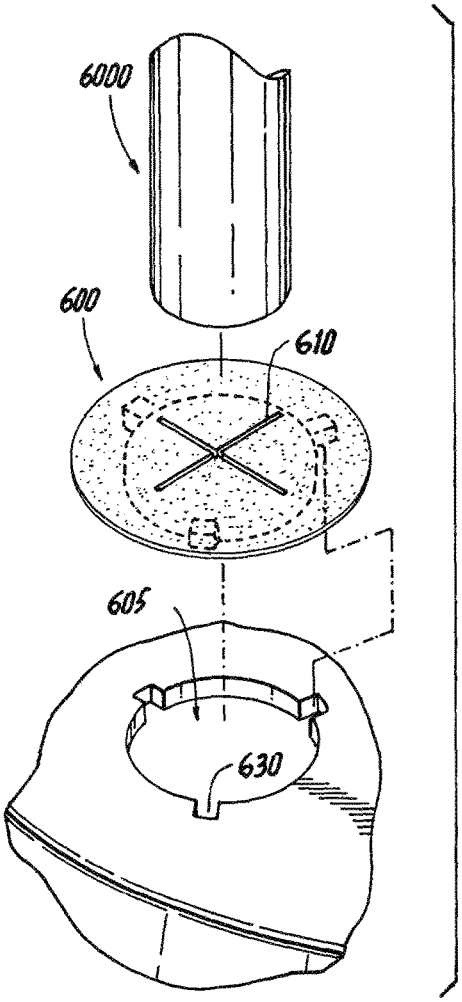
FIG. 12 shows a top exploded perspective view of an elastomeric disk mated to a hole and receiving an elongate object, in accordance with an illustrative embodiment of the invention.
Figure 13:
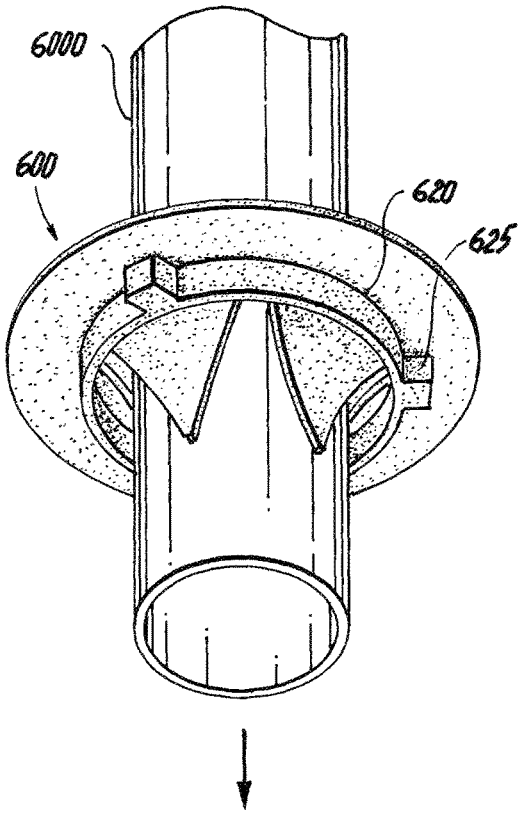
FIG. 13 shows a bottom perspective view of the FIG. 12 elongate object and elastomeric disk with the elongate object penetrating the elastomeric disk.

In even additional alternative embodiments, the upper and lower holes in the upper and lower trays may be provisioned with elastomeric disks rather than hole tabs or receiving cups. FIG. 12 shows a top exploded perspective view of an elastomeric disk 600 mated to a hole 605, and receiving an elongate object 6000, in accordance with an illustrative embodiment of the invention, while FIG. 13 shows a bottom a perspective view of the elongate object 6000 penetrating the elastomeric disk 600. The elastomeric disk 600 defines two intersecting slits 610 that pass through the elastomeric disk 600 in the pattern of an "x." In the present, non-limiting embodiment, the elastomeric disk 6000 is fixated to the hole 605 via a ring 620 and tabs 625 in the elastomeric disk 600, which engage complementary notches 630 at the circumference of the hole 605. That said, there are a number of alternative means by which an elastomeric disk could be fixated to a hole (e.g., compressive fit, gluing, heat bonding), and these alternatives would also fall within the scope of the invention. When the elastomeric object 6000 is passed through the slits 610 in the elastomeric disk 600, the elastomeric disk 600 parts into four petals, which act to place a compressive gripping force on the elongate object

6000. The elongate object 6000 is thereby held firmly in a vertical orientation in the hole 605. The elastomeric disk 6000 may comprise, for example, rubber.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in AIA 35 U.S.C. § 112(f). In particular, the use of "step of" in the claims herein is not intended to invoke the provisions of AIA 35 U.S.C. § 112(f).

What is claimed is:

1. An apparatus comprising:

a bucket comprising:

a base; and a cylindrical sidewall attached to the base;

an upper tray occupying the bucket and comprising:

an upper disk defining a plurality of upper holes therethrough;

a plurality of upper edge projections projecting from a circumference of the upper disk; and an upper socket;

a lower tray occupying the bucket and comprising a lower socket; and a pillar occupying the bucket, and inserted into the upper socket and into the lower socket so as to suspend the upper tray over the lower tray when the base is resting on a level surface;

wherein the cylindrical sidewall is applying a compressive force to the upper tray via the plurality of upper edge projections.

2. The apparatus of claim 1, wherein the upper tray further comprises a plurality of upper hole tabs, a respective set of the plurality of upper hole tabs projecting from a respective perimeter of each of the plurality of upper holes.

3. The apparatus of claim 2, wherein the plurality of upper hole tabs are angled towards the base.

4. The apparatus of claim 1, further comprising a plurality of elastic disks, a respective one of the plurality of elastic disks fixated to each hole, and each elastic disk defining a respective slit therethrough.

5. The apparatus of claim 1, wherein the plurality of upper edge projections are angled towards the base.

6. The apparatus of claim 1, wherein the lower tray rests on the base.

7. The apparatus of claim 1, wherein each of the plurality of upper edge projections defines a respective set of projecting teeth pressing against the cylindrical sidewall.

8. The apparatus of claim 1, wherein each of the plurality of upper holes is polygonal.

9. The apparatus of claim 2, wherein each of the plurality of upper hole tabs is at least partially arcuate.

10. The apparatus of claim 1, wherein the lower tray is substantially identical to the upper tray.

11. The apparatus of claim 1, wherein the lower tray further comprises:

a lower disk defining a plurality of lower holes therethrough; and a plurality of lower edge projections projecting from a circumference of the lower disk.

12. The apparatus of claim 11, further comprising a plurality of receiving cups, a respective one of the plurality of receiving cups being suspended from a respective perimeter of each of the plurality of lower holes.

13. The apparatus of claim 1, wherein the upper tray comprises a plastic.

14. The apparatus of claim 1, wherein the lower tray is nestable in the upper tray.

* * * * *